US005088776A

United States Patent [19]

James

[11] Patent Number: 5,088,776

[45] Date of Patent: Feb. 18, 1992

[54] LOCKING MECHANISM FOR A SAFE DOOR

[76] Inventor: C. Thomas James, 460 N. 880 East, Springville, Utah 84663

[21] Appl. No.: 614,625

[22] Filed: Nov. 16, 1990

Related U.S. Application Data

[63] Continuation-in-part of Ser. No. 607,996, Nov. 1, 1990, which is a continuation-in-part of Ser. No. 374,257, Jun. 30, 1989, abandoned.

[51] Int. Cl.[5] ..... E05C 9/12

[52] U.S. Cl. ..... 292/33; 109/59 R

[58] Field of Search ..... 109/59 R; 292/33, 39, 292/51, 142, 172

[56] References Cited

U.S. PATENT DOCUMENTS 473,800 4/1892 Van Broek ..... 292/39
1,600,982 9/1926 Golloway et al. ..... 292/39 X
3,308,579 3/1967 Thams ..... 292/39 X
4,679,415 7/1987 Spratt ..... 292/39 X

*Primary Examiner*—Richard E. Moore
*Attorney, Agent, or Firm*—Trask, Britt & Rossa

[57] ABSTRACT

A locking mechanism for securing a door of a safe within a frame includes a drive gear rotatably mounted on the interior surface of the door. An extension fitted with a rack gear is mechanically cooperated with the drive gear. The extension is adapted to be slidingly displaced along the interior surface of the door so as to extend outwardly from a corner of the door and be detachably engaged or abutted against the inwardly facing side of a door frame, more specifically, a corner of the door frame. The intercooperation of the extension and the frame forms a securement of the door and particularly the corner of the door within the door frame.

9 Claims, 7 Drawing Sheets

LOCKING MECHANISM FOR A SAFE DOOR

RELATED APPLICATIONS

This application is a continuation-in-part application of application Ser. No. 07/607,996, filed Nov. 1, 1990, entitled "LOCKING MECHANISM FOR A SAFE DOOR,", which is a continuation-in-part application of application Ser. No. 374,257, filed June 30, 1989 and entitled "LOCKING MECHANISM FOR A SAFE DOOR" now abandoned.

BACKGROUND OF THE INVENTION

1. Field

This invention relates to locking systems, particularly those used for gun safes and other types of lightweight safes.

2. Statement of the Art

In the past decade, public awareness of the hazards arising from private gun ownership has increased markedly. As politicians grapple with the issue of ensuring the safety of the public while protecting the constitutionally endowed rights of private gun ownership, individual gun owners have become more aware of the need to safeguard their personal gun collections. One of the more popular approaches adopted by these individuals is the purchase of a lightweight safe designed for storing rifles as well as handguns. These safes at once provide security against criminal activities, e.g. burglary, while at the same time providing a means of precluding access to the weapons by children.

These safes typically assume a substantially box-like appearance having a hinge-mounted, rectangularly shaped door which provides access to the safe's hollow interior. For years, safe manufacturers have relied on a locking mechanism which provides for a series of studs or bolts to be urged outwardly from the four-sided perimeter of the door, into recess wells defined in the door's frame. Various mechanical arrangements have been proposed to effect the actuation of these bolt members.

U.S. Pat. No. 393,883 (Brown) illustrates a safe door adapted with a plurality of stud-fitted yokes positioned about the perimeter of the door. Each yoke includes a shaft which extends towards the center of the door face and is retained for back-and-forth displacement within a series of bracket-like guides. The shafts are interconnected one with another by a pivot mounted linkage assembly. The locking mechanism is actuated by a spring.

U.S. Pat. No. 1,870,746 (Pyle) discloses a safe door wherein a rotatably mounted disc is fitted with a first plurality of pinned outwardly-extending shaft linkages. Two of the linkages are pinned at their opposing ends to a respective second rotatably mounted disc. A second plurality of linkages extend from pinned mountings in the second discs to the perimeter of the door. Each of the linkages in the second plurality of linkages is fitted at its free end with a stud adapted for insertion into a frame defined recess well. Additionally, one of the first linkages is also adapted at its free end with a stud adapted for insertion into a frame defined recess well.

U.S. Pat. No. 1,929,341 (Wegner) describes a locking mechanism adapted for use in closing a burial vault. In this construction, a disc, centrally positioned and rotatably mounted on the vault door, is fitted with a plurality of outwardly extending shafts. Each shaft is fitted on its free end with a yoke fitted with a plurality of outwardly extending studs or legs adapted for cooperating with structure defined on the main body of the vault for effecting a unison of the door with the vault body.

U.S. Pat. No. 2,823,536 (Watson) discloses a safe door mechanism which utilizes two spacedly positioned discs rotatably mounted on as safe door. Each disc is fitted with two pinned shafts which extend outwardly to the door's perimeter and are adapted at their ends to be received within frame defined recess wells to form a secured union of the door with the safe door frame.

U.S. Pat. No. 2,860,584 (Deaton et al.) discloses a bolt and lock construction adapted for use with vault doors.

SUMMARY OF THE INVENTION

A locking mechanism for use with a door of a lightweight safe is disclosed. The locking mechanism is adapted preferably for use with a door having a plurality of sides, e.g. a polygonally-shaped door, wherein pairs of sides intersect to form corners. The locking mechanism is specifically designated for use with quadrilaterally shaped planar doors.

The locking mechanism includes a drive gear which is rotatably mounted on the interior surface of the door. A drive means, mechanically associated with the drive gear, is adapted for permitting the safe's user to rotate the drive gear from the door's exterior surface.

A second gear, e.g. a rack gear is mechanically cooperated with the drive gear. An extension or stud mounted on the second gear and displaceably secured to the door interior surface is adapted to be displaced by the second gear to extend outwardly from the corner of the door panel. The extension may be adapted to be displaced along the interior surface of the door.

The door is disposed within a door frame which defines an opening corresponding to the outer perimeter of the door. The frame defines corners therein which are configured to receive the corners of the door.

When the door is positioned within the door frame in a closed position, a rotation of the drive gear induced by activation of the drive means effects a displacement of the extension outwardly from the corner of the door. The extension is extended along the side of the frame sufficiently to abut against the side of the frame and form a detachable engagement of the corner of the door with the door frame. The extension secures the door corner within the frame thereby limiting, if not precluding, a breach of the safe's integrity by an individual peeling back or otherwise attacking the corner of the safe door.

The second gear and its associated extension may be retained on the interior surface of the door by means of a guide or bracket assembly. This assembly, which is secured directly to the interior surface of the door, may define an opening therein which slidably receives the second gear or extension being retained.

In one construction, the guide assembly is formed of a plurality of members, preferably two members which define the referenced opening in their surface of contact one against the other, i.e. an interfacial surface. The members are detachably secured to one another by a connection means. Upon the disassembly or disunion of the connection means, the two members are separable from one another. In their assembled condition, the two members form a rack gear or extension retaining assembly. Upon their manual disassembly of the connection means, the two members are separated thereby freeing the rack gear or extension. This, in turn, facilitates the removal of the rack gear or extension from the door for purposes of maintenance or servicing.

The locking mechanism of the invention may include the provision of a rack gear/extension assembly on each corner of the door panel. In these constructions, each rack gear/extension assembly may be fitted with a respective drive gear. A drive means, adapted for rotating all of the drive gears simultaneously from a single, user activated handle, may be provided.

A supplementary locking mechanism adapted for displacing one or more securement-providing extensions, i.e., studs from the door into engagement with the sides of the door frame may also be provided in conjunction with the corner engaging extensions.

DETAILED DESCRIPTION OF THE INVENTION

A preferred embodiment of the invention is disclosed in FIGS. 1-10.

The Safe

Figure 1:
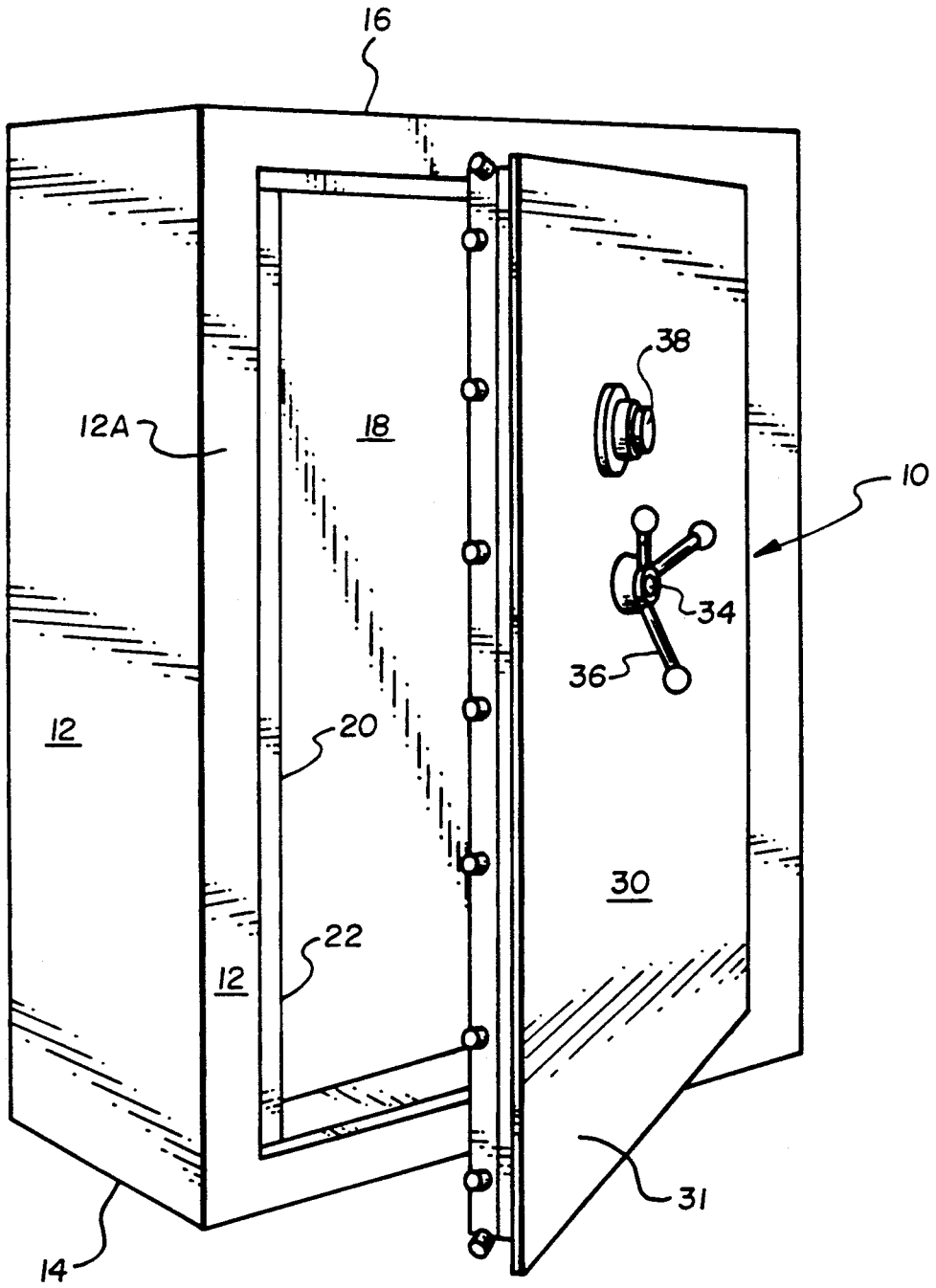
FIG. 1 is a perspective view of a lightweight safe fitted with the locking mechanism of the invention.
Figure 2:
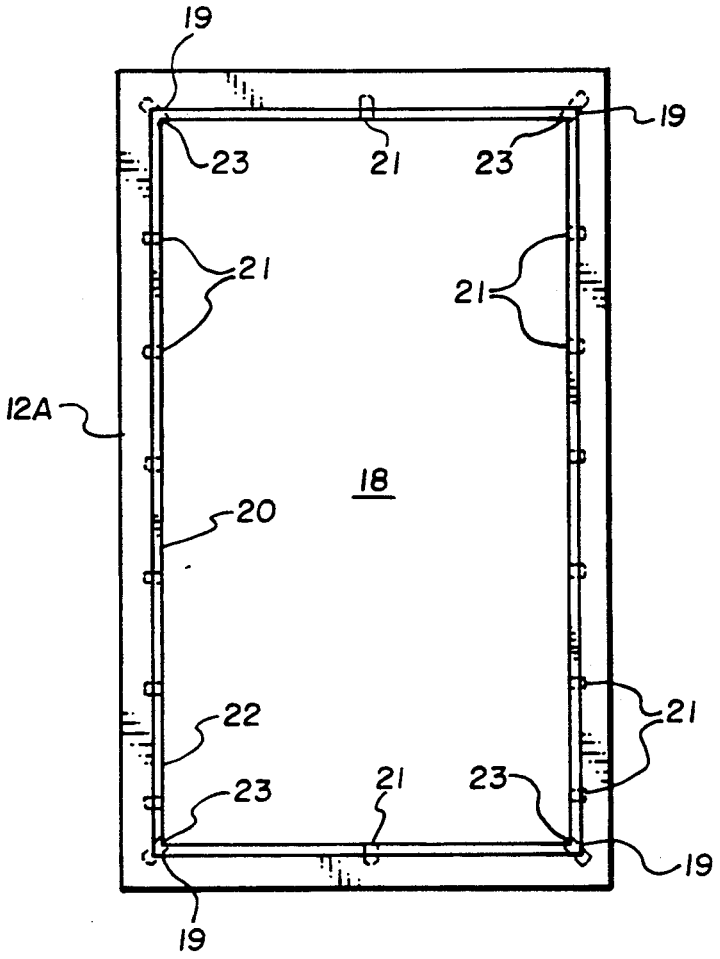
FIG. 2 is a front elevational view of the safe of FIG. 1 wherein the door has been removed for clarity.

As shown in FIGS. 1 and 2 a lightweight safe generally 10 includes a plurality of upright planar panels 12 mounted to each other on their upright edges to form a box-like configuration. A bottom panel 14 is mounted to the lower perimeter of the box-like configuration. A top 16 is mounted to the top of the box-like configuration whereby the safe 10 is totally enclosed.

FIG. 2 illustrates the front upright panel 12A as defining a generally rectangular opening 18 therein. The opening 18 is enclosed by a frame 20 composed of a plurality of "L"-shaped panels 22 which extend from the panel 12A inward to the hollow interior of the safe. The panels 22 are joined together at their ends to form a generally rectangular frame structure. As shown, frame 20 defines four corners 19. Each corner is formed at the insertion of two panels 22.

The Door

Figure 4:
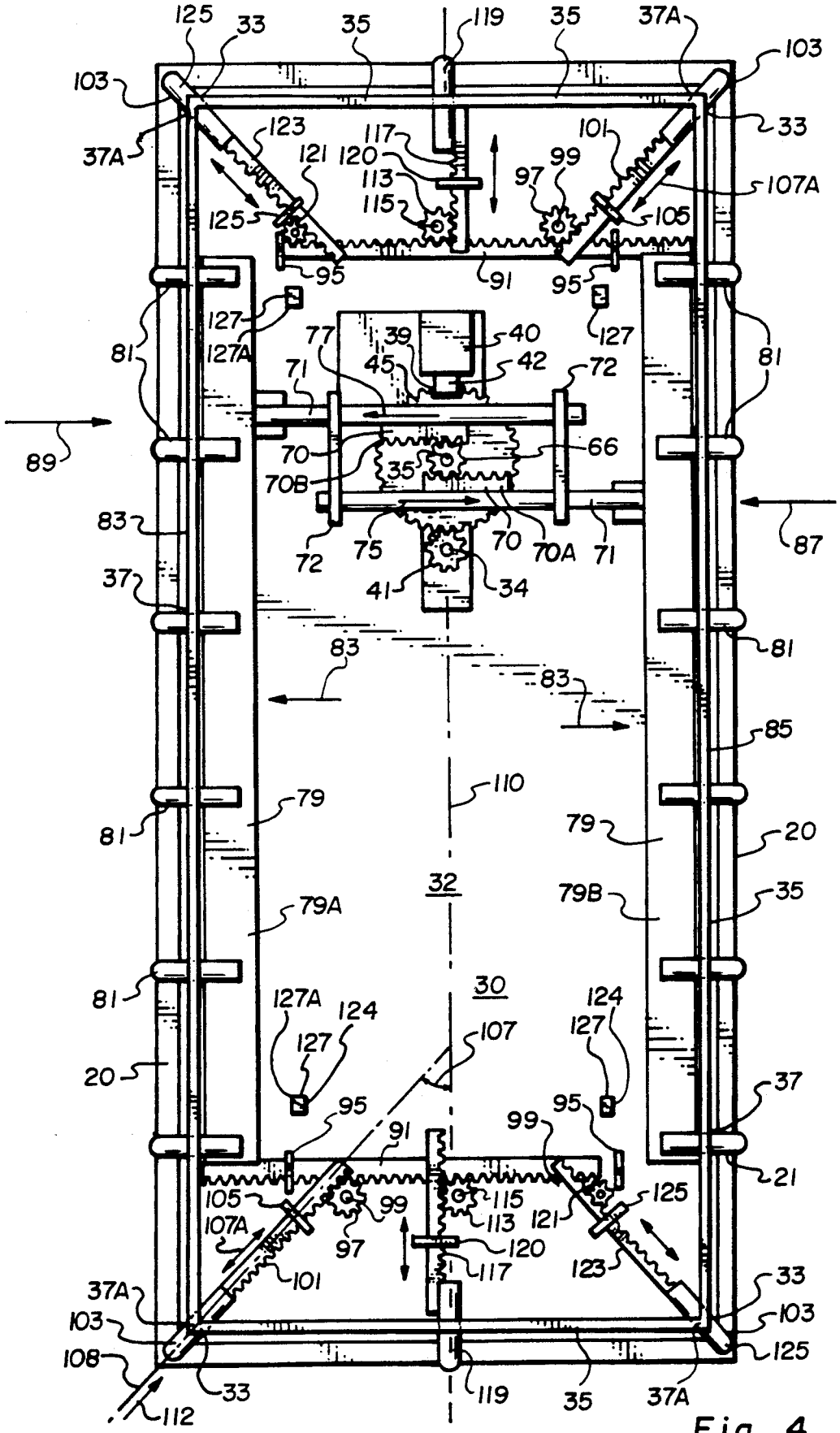
FIG. 4 is an elevational view of the interior of the door of the lightweight safe.

The door 30 of the invention is a rectangularly configured planar panel having an exterior face 31 and an interior face 32, as shown in FIG. 4.

The panel of door 30 defines four corners 33 which are positioned about the perimeter of the door. A corner is formed at the intersection of each pair of sides which constitute the door's perimeter.

Figure 3:
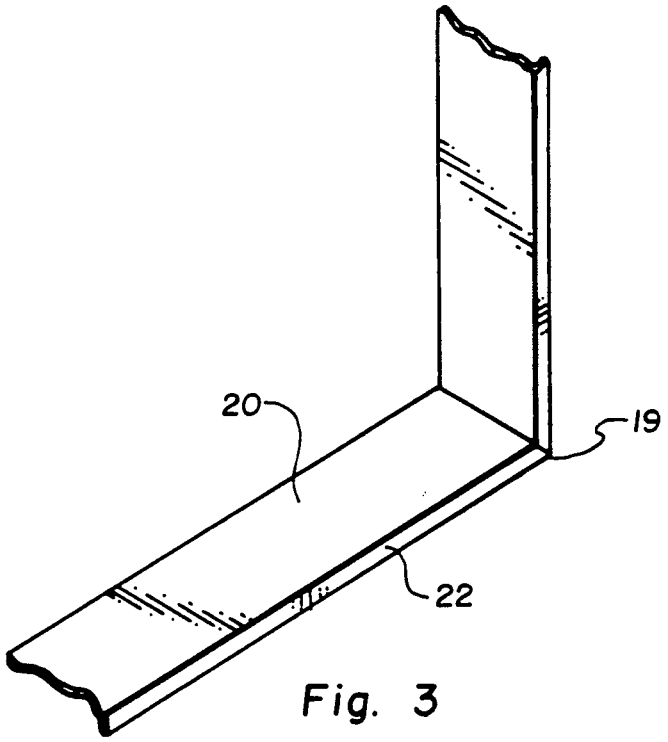
FIG. 3 is a sectional view of a corner of the door and frame of the safe of FIG. 1.

Mounted upright on the interior face 32 of the door panel are a plurality of planar panels 35. As shown in FIGS. 1 and 4, each panel 35 is generally linear in configuration and is positioned proximate a side of the door panel. Each panel 35 extends parallel along its respective side. Each panel 35 intersects and is securely connected to a respective second panel 35 on each of its ends. The association of the four panels 35, as shown in FIGS. 3 and 4 produces a rectangularly-configured frame-like structure. As shown in FIGS. 2 and 3, the panels 35 define a plurality of apertures 37 which are spacedly positioned along the length of each panel 35. Further, at each intersection of a pair of panels 35, an aperture 37A is defined.

An elongate, cylindrical drive shaft 34 is journaled through the door 30 and may be supported by bearings. A spoked wheel-like handle 36 is mounted on the outwardly extending end of axle shaft 34. Handle 36 is configured to be grasped and rotated by the safe's user as a means of operating the locking mechanism. A toothed primary drive gear 41 is fixedly mounted on the inwardly-extending end of axle shaft 34.

The Key Lock

A key-lock mechanism 38 is mounted on the exterior face 31 of the door 30. This mechanism, which may be of a conventional tumbler-type, communicates with the interior face of the door through an aperture defined within the door 30. The key-lock mechanism is adapted to receive a key and to permit that key's rotation, thereby actuating a securement mechanism 40 mounted on the interior face 32 of the door 30. Alternatively, the key lock mechanism 38 may be a conventional rotatable dial or combination lock-type mechanism.

The Interior Securement Mechanism

As shown in FIG. 4, the locking mechanism 40 includes a lateral extending displaceable bolt 42. The bolt 42 is adapted to be displaced vertically, either upwardly or downwardly by the key's rotation in the key lock mechanism 38. Upon a given downward displacement, it is received within a recess well 39 defined within toothed gear 45 which is rotatably mounted on the interior end of axle shaft 35. Axle shaft 35 is secured to the interior face 32 of door 30 and extends outwardly therefrom. The bolt 42 is sized to be received between a pair of adjacent teeth of gear 45. Since the bolt 42 is not adapted to be rotated, but merely displaced vertically, upon its positioning between the described pair of adjacent teeth, it interdicts and locks the gear 45 in place and prevents any rotation of that gear 45.

The teeth of primary drive gear 41 are mechanically intercooperated, i.e., meshed with the teeth of gear 45 whereby a rotation of primary drive gear 41 effects a corresponding rotation of gear 45.

Gear 45 is of a conventional spur gear construction and is adapted to be rotated both clockwise and counterclockwise. Fixedly mounted n gear 45 is a toothed pinion gear 66. This pinion gear 66 is rotatably journaled on cylindrical axle 35. Pinion gear 66 is interposed between a pair of toothed rack gears 70.

The teeth of pinion gear 66 are meshed with a pair of elongate rack gears 70. Each rack gear 70 is fixedly mounted on a respective elongate cylindrical support shaft 71. The support shafts 71 are retained spacedly apart about gear 66 yet are oriented parallel to one another in a horizontal orientation. The shafts 71 are retained in position by two guides or supports 72 mounted on the interior face of the safe door. Each guide 72 may be essentially a planar panel member having an aperture, preferably circular, defined therein configured to receive a respective shaft 71. The guides 72 are adapted to retain the teeth of rack gears 70 in mechanical engagement with the teeth of pinon gear 66, while also permitting that rack gear 70 to be slidingly displaced horizontally, i.e. laterally, upon a clockwise or counterclockwise rotation of pinion gear 66.

The shafts 71 are adapted for lateral displacement in opposing directions, e.g., upon a counterclockwise rotation of gear 66, rack gear 70A is directed to the right as indicated by arrow 75 while rack gear 70B is directed to the left as indicated by arrow 77.

Mounted on the end of each shaft 71 is a vertically disposed panel or shaft 79. Secured to each panel 79 is a plurality of elongate studs 81 which are each positioned to extend through a respective aperture 37 defined in the panels 35. As the shafts 71 are displaced by the interaction of rack gears 70 and drive gear 66, the panels 79, together with their studs 81, are displaced in the directions indicated by respective arrows 83.

Each of the apertures 37 defined in panels 35 is positioned to register with a respective aperture 21 defined within the frame 20. The panels 79 align the studs 81 such that each stud 81 may be displaced through a respective aperture 37 and thereafter into engagement with the inwardly facing side of the door frame 20 to form a locking securement of the door 30 within the frame 20.

The panels 79 are positionable in two conditions, an open condition and a closed condition. In the closed condition illustrated in FIG. 4, the panels 79 have been displaced outwardly toward the sides 83 and 85 of the door 30 sufficiently that each of the studs 81 have each been driven through its respective aperture 37 and subsequently been positioned in engagement against the side of frame 22. Recognizably, the abutment of the studs 81 against the inwardly facing sides of the frame 20 preclude the opening or the rotation of the door 30 about its hinges.

The open condition of the panels is obtained upon a clockwise rotation of the pinion gear 66. In this operation, the rack gear 70A is driven the direction indicated by arrow 87 while rack gear 70B is driven in the direction illustrated by arrow 89. Upon a sufficient rotation of gear 66, the panels 79 are sufficiently retracted toward the center of the door 30 that the studs 81 are retracted from engagement against the door frame 20 such that the studs 81 no longer secure the door 30 within the frame 20. In some cases, the studs 81 may still be inserted partially or perhaps completely through apertures 37 in this open condition.

Fixedly mounted on an end of each panel 79 is a rack gear 91. Each rack gear 91 is slidably retained within a guide 95 which is secured to the interior face 32 of door 30.

The guides 95, together with the guide 72, retain each of the panels 79 and their associated studs 81 in an orientation on the door 30 so as to retain the studs 81 in alignment with their respective apertures 37.

The teeth of each rack gear 91 are mechanically meshed with a respective pinion gear 97 which is rotatably journaled on an upright axle shaft 99 secured to the interior face 32 of door 30.

An elongate rack gear 101 having a stud or shaft 103 mounted on an end thereof, is slidably and displaceably mounted within a support guide 105 which is mounted on interior face 32 of door 30. As shown, the teeth of rack gear 101 are meshed with pinion gear 97. The shaft 103 is positioned to register with and pass through aperture 37A defined at the corner 33 formed by the intersection of two panels 35.

The longitudinal axis 108 of shaft 103 and rack 101 is oriented at an acute angle 107 to the longitudinal axis 110 of door 30.

The rack gear 101 is adapted to be displaced along the directions indicated by arrow 107A. As the panels 79 are displaced toward the sides 83 and 85, the rack gears 91 effect a counterclockwise rotation of pinion gear 97 which, in turn, causes the rack gears 101 and their attendant shafts 103 to be driven outwardly through apertures 37A. The shaft 103 may then be further inserted into engagement with the side of door frame 20 to form a securement of the corner 110 of the door 30 within the frame 20.

When panels 79 are retracted to their open position, the rack gear 91 effects a clockwise rotation of pinion gear 97 which, in turn, causes the rack gear 101 and shaft 103 to be displaced in the direction of arrow 112 sufficient to remove the shaft 103 from engagement or abutment against the side of door frame 20 so as to permit the door 30 to open.

The teeth of each rack gear 91 are meshed with a pinion gear 113 which is rotatably journaled on an axle shaft 115. Shaft 115 is uprightly secured to the interior face 32 of door 30.

The door 30 is also fitted with a pair of rack gears 117. The teeth of each elongate rack gear 117 are meshed with a respective pinion gear 113. Each rack gear 117 is fitted on its end with a stud or shaft 119 which is slidably received within an aperture 37 defined in a panel 35. The rack gear 117, together with its associated shaft 119, is displaceably mounted in a support guide 120.

The displacement of the shaft 119 and rack gear 117 is coordinated with that of panel 79, i.e. as panels 79 are urged toward sides 83 and 85 of door 30, likewise the shaft 119 is directed outwardly through aperture 37 into engagement or abutment with the sides of the door frame 20. As the panels 79 are retracted toward the center, i.e. the longitudinal axis 110 of door 30, the shaft 119 is retracted from its abutment against the inwardly facing side of door frame 20.

As shown to advantage in FIG. 4, a door locking mechanism of the invention may include two rack gears 91 together with their associated rack gears 101 and 117. In the configuration of FIG. 4, the rack gears 91 are positioned on opposite sides of the door. Further, one rack gear 91 is positioned on the top of the door while the other rack gear 91 is positioned proximate the bottom of the door.

The teeth of each rack gear 91 are also mechanically meshed with an associated rotatably mounted pinion gear 121 As shown in FIG. 4, pinion gear 121 is meshed with a rack gear 123. Each rack gear 123 is fitted with a respective shaft or stud 125. The rack gear 123 is slidably supported on the interior face 32 of door 30 by a guide 125. Each rack gear 123 is adapted to be displaced in the directions indicated by arrow 126. In a first displacement, the studs 125 are abutted against the inwardly facing side of door frame 20 sufficiently to form a securement of the door 30 within the frame 20.

The locking mechanism may also include a plurality of stops 124 which function to preclude further displacement of panels 79 in a given direction. As shown in FIG. 4, the stops 123 may include a plurality of shafts 127 mounted upright on the interior surface 32 of door 30. The shafts 127 are mounted a selected distance from the sides 83 and 85 and extend a sufficient distance from the face 32 of door 30 that they are positioned within the path of travel of respective panel 79. The shafts 127 are mounted such that upon the panel 79A being displaced a sufficient distance in the direction indicated by arrows 89 and the panel 79B being displaced in the direction indicated by arrows 87 such that the studs 81 have been retracted from their respective abutment or engagement against the door fame 20, thereby permitting the door 30 to rotate open about its hinges, the shafts 127A abut against the panel 79A to preclude its further displacement in the direction of arrow 89. Further, the shafts 127B abut against the panel 79B to preclude its further displacement in the direction indicated by arrow 87.

Figure 5:
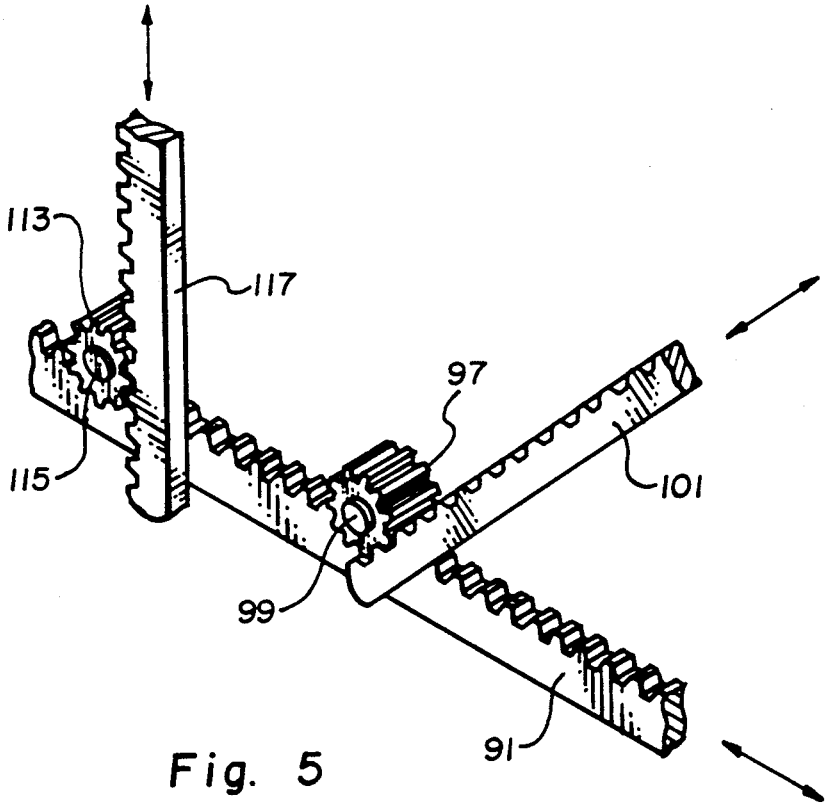
FIG. 5 is a sectional view of the drive gear of the mechanism in association with the extension of that mechanism.

As shown in FIG. 5, rack gears 117 and 101 are spaced above the interior face 32 of door 30 such that they pass over and atop rack gear 91. This spacing is achieved by means of the guides 120 and 105 (FIG. 4).

Figure 6:
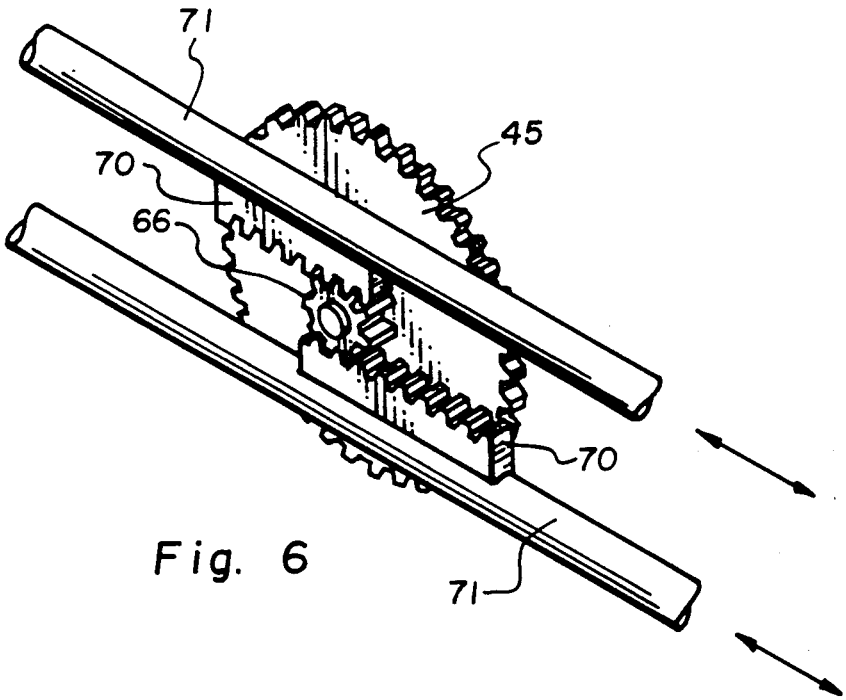
FIG. 6 is a sectional view of the primary gear in association with a pair of first rack gears.

FIG. 6 illustrates the intercooperation of pinion gear 66 and the rack gears 70A and 70B together with their respective shafts 71.

Figure 7:
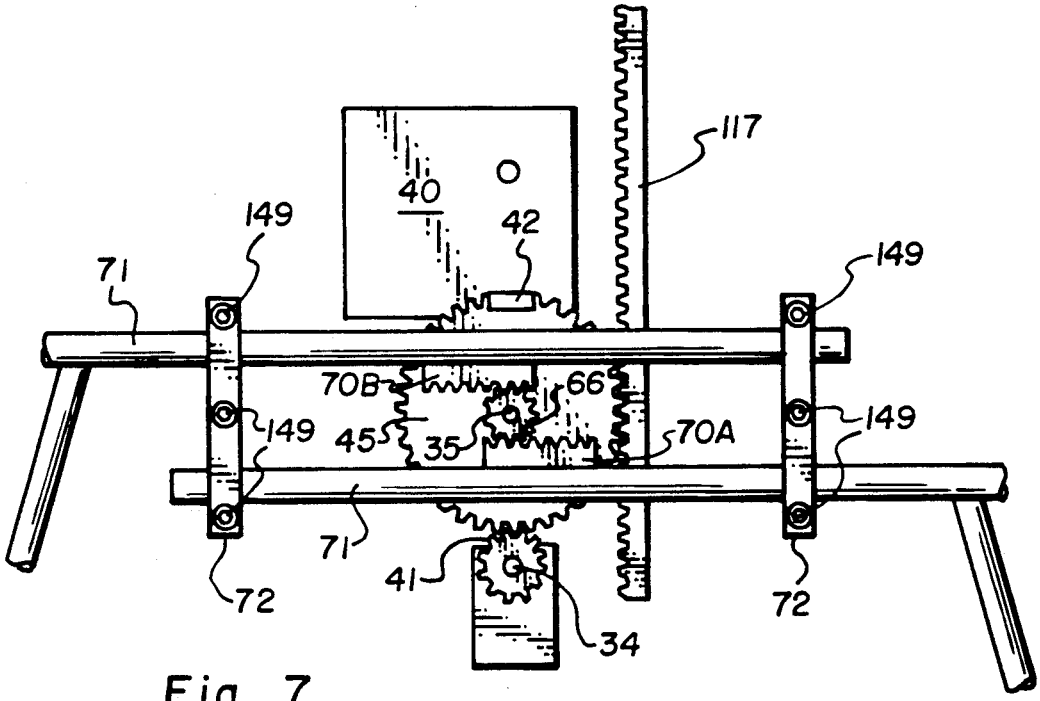
FIG. 7 is a sectional front view of an alternative construction of the locking mechanism.

FIG. 7 illustrates an alternative embodiment of the invention wherein the rack gear 117 is mechanically engaged with the gear 45 as opposed to the pinion gear 113.

Figure 8:
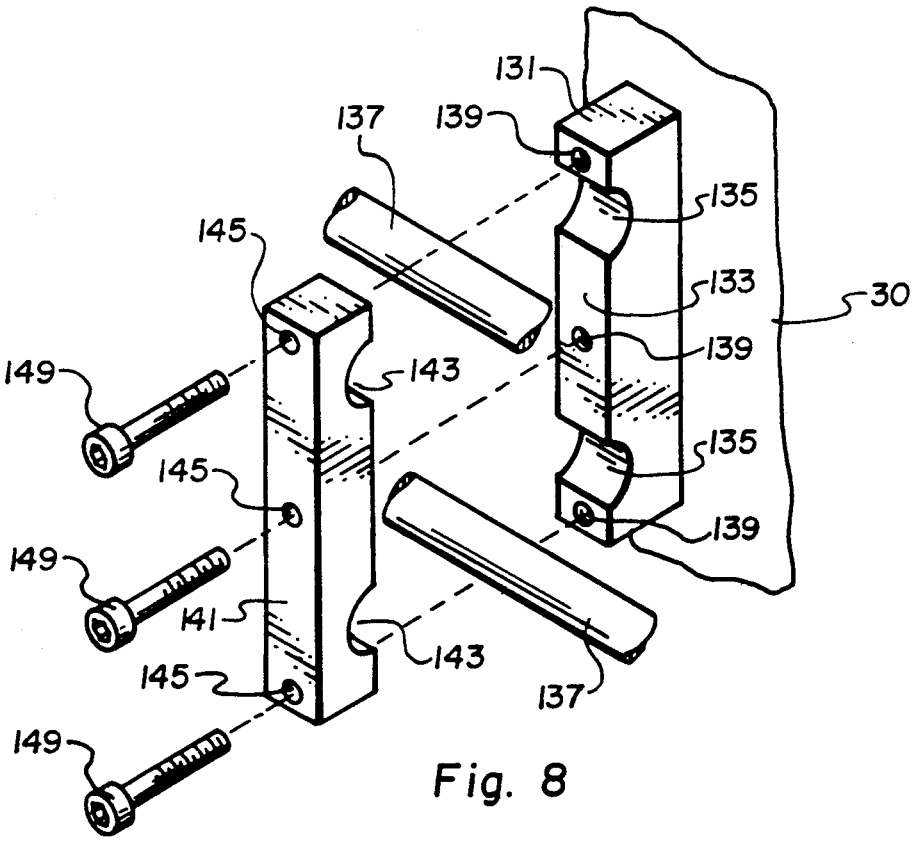
FIG. 8 is an exploded sectional view of a retainer guide adapted for slidingly retaining a first rack gear.
Figure 9:
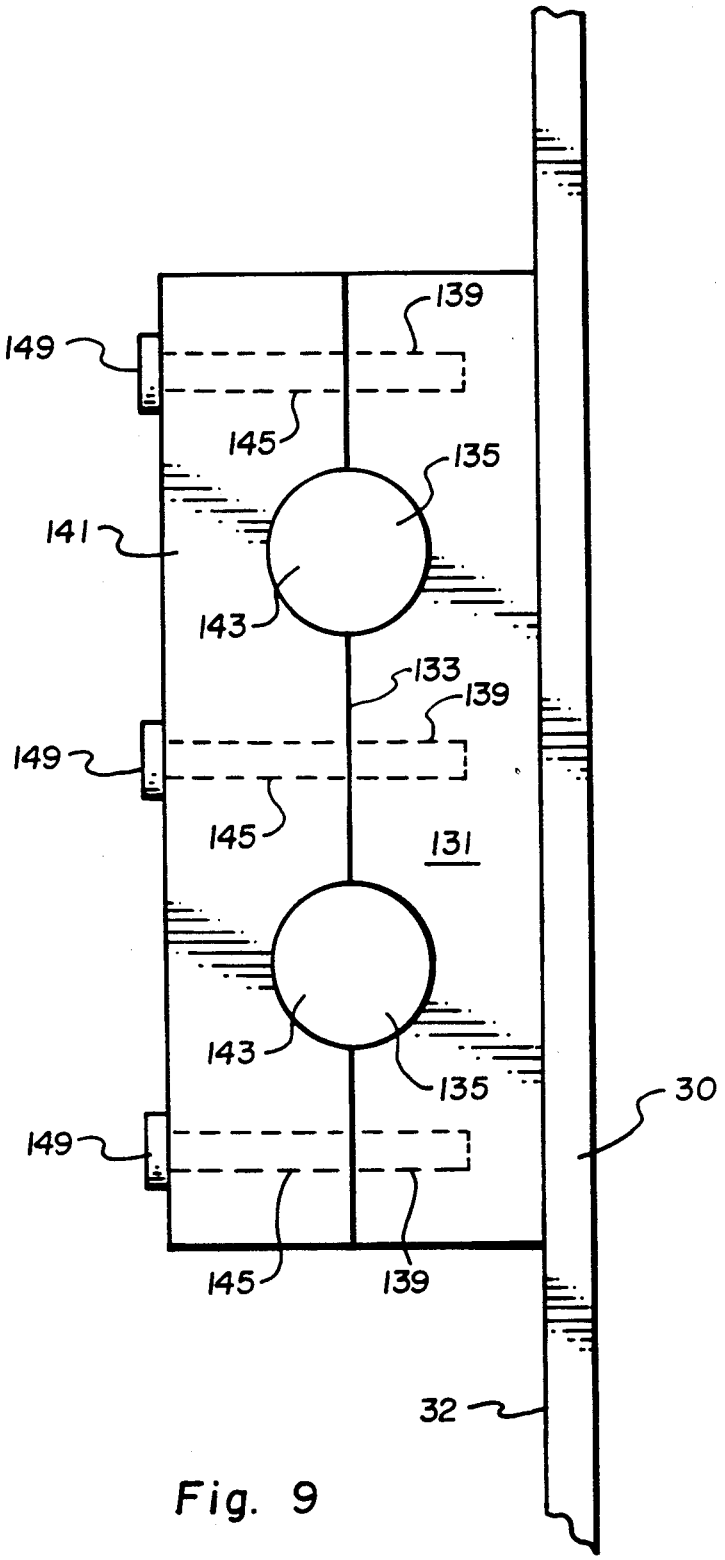
FIG. 9 is a side view of the guide of FIG. 8.
Figure 10:
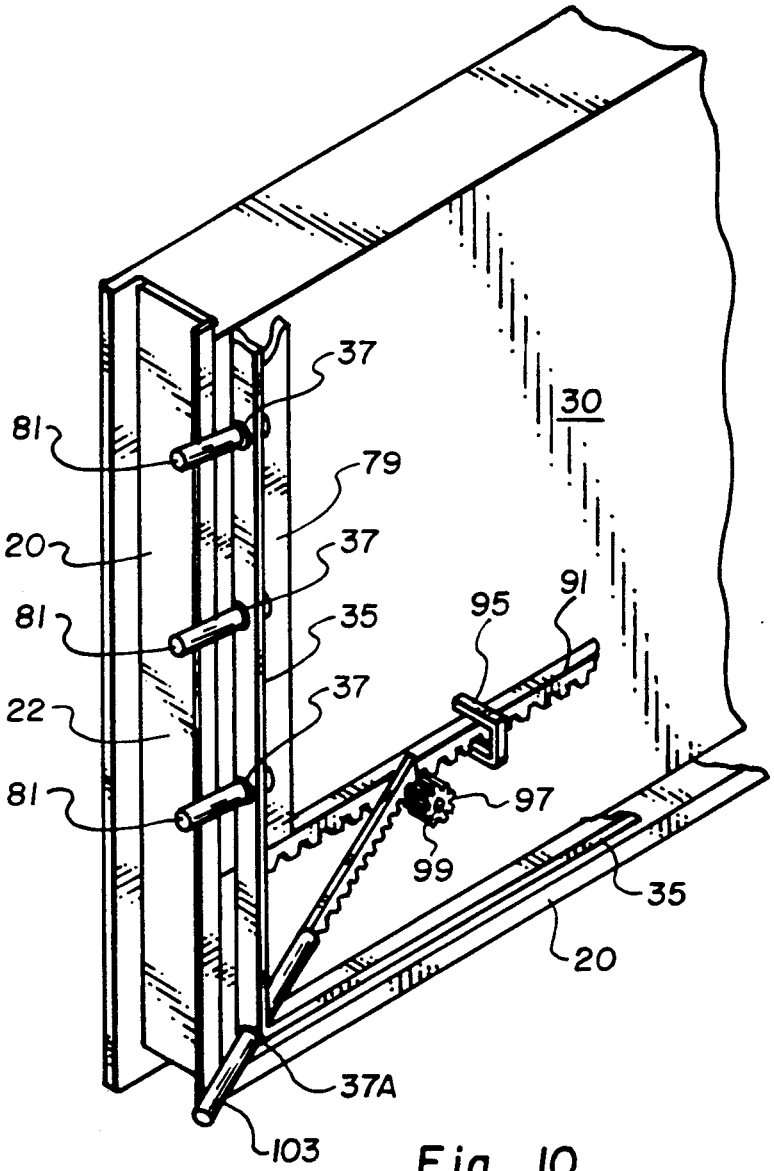
FIG. 10 is a partial side view of the door frame and a stud of the locking mechanism assembly engaged thereagainst.

FIGS. 8 and 9 illustrate a novel guide assembly which may be utilized for any of the guides mounted on the interior face 32 of door, specifically guides 72, 95, 105, 120 or 125. As shown, the guide assembly may be formed by a first member 131 which is fixedly secured to the interior face 32 of door 30. The outwardly-extending face 133 of member 131 defines one or more channels 135 which are configured to correspond to the exterior surface configuration of the member to be carried by the guide. In the embodiment illustrated in FIG. 8, the member to be carried is a cylindrically-shaped shaft 137 corresponding to a shaft 71. Channel 135 is thus configured as a semi-circular or half-cylindrical channel. Member 131 also defines a plurality of female-threaded holes 139 therein which are spacedly positioned along the length of the member.

A second member 141 defines a plurality of channels 143 therein which correspond generally to the channels 135 of member 131. Member 141 also defines a plurality of female-threaded holes 145 which are positioned along member 141 such that when the two members are positioned contiguously, the holes 145 and 139 are in register. A plurality of male-threaded bolts 149 are provided. Each bolt 149 is threadedly inserted into a respective pair of holes 145 and 139 to secure the two members 131 and 141 together. Upon the two members 131 and 141 be secured thusly, the channel 135 is positioned adjacent a corresponding channel 143 to form a completely cylindrically shaped channel dimensioned to slidably receive and retain a respective shaft 137. As seen in FIG. 9, the two members 131 and 141 define a pair of complete channels 150 along the common interfacial surface of the members.

The instant guide assembly is readily disassembled by threadedly retracting the bolts 149 from their respective holes 145 and 139 and then removing the second member 141 from its engagement with the first member 131.

While previous bracket constructions in other safe constructions have often necessitated the complete removal of the door 30 from the safe 10 in order to remove the various rack gears, shafts, panels and studs of the locking mechanism from the door for maintenance purposes, the present guide assembly permits the user to readily disassemble the guides from a door and thereafter easily remove the rack gears, shafts, panels and studs while the door remains mounted to a safe. Noticeably, the new guide assembly measurably reduces repair and maintenance time.

Conventional safe door construction provides for stud-fitted extensions which are displaceable along the interior surface of the door to extend outwardly from the side of the door, i.e. along the vertically-oriented sides together with the laterally-extending top and bottom sides. While this construction provides considerable security for the sides of the door, attention has now been focused on the corners of the door. It has been found that vandals may compromise the door by attaching one or more of the corners of the door. Since conventional doors don't provide for studs to be secured within the frame in the corners of the frame, the corners of the door have proved to be a vulnerable target for would-be vandals.

There exists a present need to remedy this vulnerability of conventional safe constructions.

It is to be understood that the embodiments of the invention described are merely illustrative of the application of the principles of the invention. Reference herein to the details of the illustrated embodiment is not intended to limit the scope of the claims which themselves recite those features regarded as essential to the invention.

What is claimed is:

1. A locking mechanism for use with a door having an interior surface, an exterior surface, a plurality of sides and a plurality of corners, each corner being defined by an intersection of a pair of said sides, said door being enclosed in a frame having corners corresponding to said corners of said door, said frame defining an inwardly facing side, said locking mechanism comprising:

a drive gear rotatably mounted on said interior surface of said door;

an extension having a first gear fitted thereon, said extension being displaceably mounted along said door's interior surface to extend outwardly from a respective corner of said door, said first gear being mechanically intercooperated within said drive gear;

a drive means mechanically associated with said drive gear adapted for permitting a user to rotate said drive gear from said exterior surface, said drive means comprising:

a drive shaft journaled through said door;

a handle mounted on said drive shaft adapted to be grasped and turned by a user;

a primary gear mounted on said drive shaft and positioned on said door's interior surface;

at least one first rack gear mechanically cooperated with said primary gear, said first rack gear being displaceable along said door's interior face;

an elongate shaft fitted with a plurality of studs configured to form a securement engagement with said frame, said elongate shaft being mounted on said first rack gear;

a second rack gear mounted on said elongate shaft, said second rack gear being mechanically cooperated with said drive gear, said second rack gear being adapted to rotate said drive gear upon a user's rotation of said drive shaft;

wherein a drive means induced rotation of said drive gear effects a displacement of said extension outwardly from said door corner into a securement-producing engagement with said aperture defined with said frame corner.

2. The locking mechanism of claim 1 wherein said door defines a longitudinal axis, said extension being displaceable along a linear path of travel which is oriented at an acute angle to said longitudinal axis.

3. The locking mechanism of claim 2 wherein said gear is a first rack gear.

4. The locking mechanism of claim 1 wherein said second rack gear is slidingly retained on said door interior surface by a guide mounted on said interior surface.

5. The locking mechanism of claim 4 wherein said second rack gear slidingly extends through an aperture defined in said guide.

6. The locking mechanism of claim 5 wherein said guide is formed of two segments releasably connected together, said segments together defining said aperture on an interface of said two segments.

7. The locking mechanism of claim 6 wherein said two segments are detachably retained together by a connecting means mounted on said segments, wherein said first rack gear is removably from said safe door upon a detachment of one said segment from another said segment.

8. The locking mechanism of claim 7 wherein said connecting means includes a pair of male-threaded bolts, each bolt being threadedly mounted into a respective female-threaded socket defined within said segments, said sockets extending through said segments, said sockets being spacedly positioned from one another about said aperture.

9. The locking mechanism of claim 1 wherein said primary gear is mechanically associated with a securement means, operable from said exterior surface, adapted to releasably secure said primary gear and prevent said primary gear from rotating.

* * * * *